United States Patent [19]

Shimomura et al.

[11] Patent Number: 4,877,002

[45] Date of Patent: Oct. 31, 1989

[54] ELECTRONIC CONTROL DEVICE FOR INTERNAL-COMBUSTION ENGINES

[75] Inventors: Setsuhiro Shimomura; Ryoji Nishiyama, both of Hyogo, Japan

[73] Assignee: Mitsubishi Denki Kabushiki Kaisha, Tokyo, Japan

[21] Appl. No.: 133,890

[22] Filed: Dec. 16, 1987

[30] Foreign Application Priority Data

Dec. 17, 1986 [JP] Japan ..... 61-301986
Dec. 17, 1986 [JP] Japan ..... 61-301987

[51] Int. Cl.[4] ..... F02D 41/16
[52] U.S. Cl. ..... 123/339; 123/352
[58] Field of Search ..... 123/339, 352, 350

[56] References Cited

U.S. PATENT DOCUMENTS 4,375,208 3/1983 Furuhashi et al. ..... 123/339
4,709,674 12/1987 Bianchi et al. ..... 123/339

FOREIGN PATENT DOCUMENTS 61-145332 7/1986 Japan .

*Primary Examiner*—Andrew M. Dolinar
*Attorney, Agent, or Firm*—Bernard, Rothwell & Brown

[57] ABSTRACT

An electronic control device for internal-combustion engines wherein the quantity of air taken in is decreased when the engine speed is greater than a target value, that is, when the deviation of the number of revolutions of engine is positive, with the engine in a slow-speed hunting state, and the quantity of air taken in is increased when the engine speed is less than a target value, that is, when the deviation of the number of revolutions is negative, or wherein the quantity of air taken in is decreased when at least one of the quantity of air taken into the engine, intake pipe pressure, and a value obtained by dividing the quantity of air taken in by the number of revolutions is greater than the target value, that is, when the deviation is positive, with the engine in the slow-speed hunting state, and also the quantity of air taken in is increased when it is less than the target value, that is, when the deviation is negative, thereby controlling the aforementioned parameters to their target values and accordingly controlling the engine speed.

3 Claims, 6 Drawing Sheets

ELECTRONIC CONTROL DEVICE FOR INTERNAL-COMBUSTION ENGINES

BACKGROUND OF THE INVENTION

1. Field of the Invention

This invention relates to an electronic control device for internal-combustion engines and more particularly to an electronic control device adapted to realize driving stability without slow-speed hunting during travel at low vehicle speed with a throttle valve in a fully closed operating point.

2. Description of the Prior Art

FIG. 1 shows an electronic control device for internal-combustion engines. Referring to FIG. 1, prior-art devices (for example Laid-Open Japanese Patent No. Sho 61-145332) will be described. In this drawing, 1 is an engine; 2 is a piston; 3 is a cylinder; and 4 is a cylinder head. To an exhaust port 5 of each cylinder of the cylinder head, an exhaust manifold 6 is connected; and to an intake port 7, an intake manifold 8 is connected. In the intake manifold 8 a surge tank 9 is provided to prevent intake air pulsation; and in the surge tank 9 an intake pressure sensor 10 is provided to sense a pressure, or an intake pipe pressure Pm, in the intake manifold 8. A numeral 11 is a throttle valve which coontrols the quantity of intake air to be fed into each cylinder through the surge tank 9; 12 is an idle speed control valve (ISCV) which controls the quantity of intake air flowing through a bypass passage 12A bypassing the throttle valve 11; and 13 is an intake temperature sensor which senses intake air temperatures. To the throttle valve 11 is directly connected a throttle position sensor 14 having a throttle valve opening sensor which outputs a signal in accordance with the amount of its opening and an idle switch which is on when the engine 1 is idling. A numeral 15 is an oxygen concentration sensor which is mounted in the exhaust manifold 6 to sense oxygen concentration in exhaust gases; 16 is a water temperature sensor which senses coolingg water temperatures of the engine 1; 17 is a distributor which applies a high voltage output to an igniter 19 at a specific timing froma spark plug 18 of the engine 1; 20 is a speed sensor which is mounted in the distributor 17 and produces a pulse signal correspondingly to the number of revolutions Ne of the engine 1; 21 is a starter sensor which senses the operating condition of a starting motor not illustrated which starts the engine 1; 22 is an air conditioner switch which senses the operating condition of a compressor for an air conditioner and 23 is a vehicle speed sensor which is mounted on a driven wheel for sensing the running condition of a motor vehicle and senses its speed.

Various sensing signals from the aforementioned intake air pressure sensor 10, intake air temperature sensor 13, throttle position sensor 14, oxygen concentration sensor 15, water temperature sensor 16 and speed sensor 20 are output to a control circuit 25, by which various controls such as the control of the quantity of fuel injected from the fuel injection valve 26 and the control of the injection timing of the spark plug 18 are effected according to the aforementioned sensing signals.

Next, the operation of the prior-art device described above will be explained by referring to the flowcharts of FIGS. 2 and 3. FIG. 2 shows a program for sensing a slow-speed hunting state of a motor vehicle, that is, unpleasant low-frequency vibration caused by the rotation of the engine 1 and longitudinal vibration of the motor vehicle taking place along therewith. At Step 301, a decision is made on whether or not the fuel is cut off; at Step 302, a decision is made on whether or not the throttle valve 11 is fully closed; at Step 303, a decision is made on whether or not the number of revolutions of engine Ne is below the specific value (1000 rpm); and at Step 304, a decision is made on whether or not the vehicle is traveling at a slow speed; each by using the output of the throttle position sensor 14, the speed sensor 20, and the vehicle speed sensor 23. The above-mentioned conditions decided will be established and the condition decision routine will proceed to Step 305 when fuel injection is being effected, the throttle valve 11 is fully closed, the number of revolutions Ne is $Ne < 1000$ (rpm), and the vehicle is traveling at a slow speed of over 2.5 km/h and under 8 km/h. At Step 305, the flag X is set at "1" to indicate the decision of the conditions. On the contrary, if any one of the aforementioned conditions judged is not decided, the routine proceeds to Step 306, and the flag X will be reset to "0".

After the sensing of a slow-speed hunting state by the decision routine in FIG. 2, the following processing is carried out on the basis of a result of flag X setting.

The routine shown in FIG. 3 is effected by the control circuit 25 by producing a control power to the igniter 19 prior to causing the spark plug 18 to spark. First, Step 401 is effected, operating and computing the ignition timing $\theta$ presumed to be optimum for the engine 1 through ordinary ignition timing control on the basis of the output of various sensors shown in FIG. 1. Next, at Step 402, the decision of the flag X is accomplished; when the flag X is "1", proceed to Step 403, where a specific ignition timing (in this case, 10° BTDC) is stored to the value $\theta R$ of the ignition timing to be actually effected. Thus, a signal to be output to the igniter 19 so as to be equal to the value $\theta R$, is controlled by the ignition execution routine not illustrated which the control circuit 25 executes at a specific crank angle. On the other hand, when the flag X is "0", proceed to Step 404, where the ignition timing $\theta$ determined by such parameters as the intake air pressure Pm computed at Step 401 and the number of revolutions of engine Ne is stored as it is to $\theta R$.

As described above, when the flag X is "1", the ignition timing is fixed at 10° BTDC without regard to the running state of the engine 1. Repeating the above-mentioned operation restrains rotational variation to prevent slow-speed hunting.

Conventional electronic control devices for internal-combustion engines have such a problem that since they merely fix the ignition timing to a value at which the gain of rotational variation will decrease after a slow-speed hunting state is decided as previously stated, and accordingly only negatively restrain the occurrence of rotational variation caused by the slow-speed hunting; therefore, if the slow-speed hunting of as large amplitude as about 100 rpm of rotational variation width is caused to occur by disturbance such as variation in a road surface or other, the occurrence of vibration caused by rotation can not fully be prevented.

SUMMARY OF THE INVENTION

The present invention has been accomplished in an attempt to solve the aforementioned problem, and has as its object the provision of an electronic control device for internal-combustion engines that is capable of fully stopping the occurrence of vibration by controlling rotational variation even when there has taken place slow-speed hunting of large amplitude of great rotational variation width.

The electronic control device for internal-combustion engines pertaining to the present invention incorporates a control means which controls the quantity of air taken into the engine correspondingly with a deviation between the number of revolutions of engine and a target number of revolutions, or a deviation between the air intake, an intake pipe pressure, etc. and their target values, in the event that the engine is in a slow-speed hunting state.

Other objects and advantages of this invention will become more apparent from the following detailed description of the preferred embodiments when read in connection with the accompanying drawings.

PREFERRED EMBODIMENTS OF THE INVENTION

Figure 1:
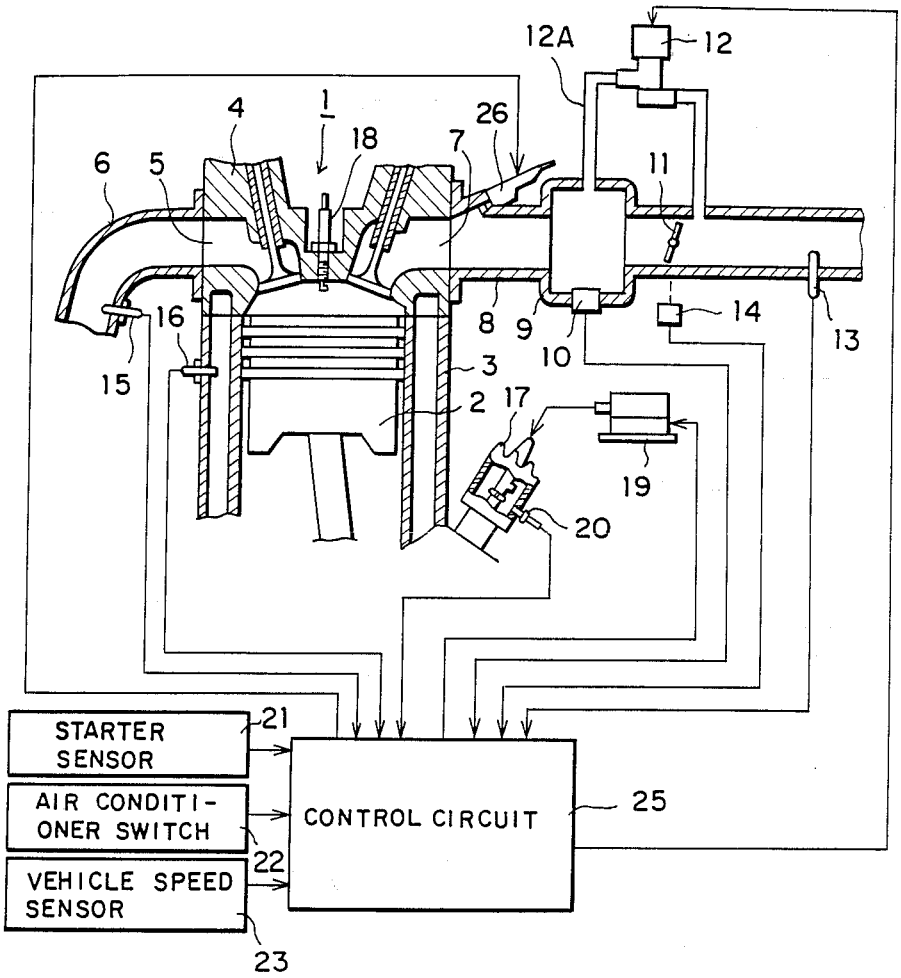
FIG. 1 PRIOR ART
FIG. 1 is a block diagram of a conventional electronic control device for internal-combustion engines.

Preferred embodiments of this invention will now be described by referring to the accompanying drawings. The constitution of the electronic control device, except the control circuit 25, is the same as FIG. 1. That is, processing and data setting in an operation part centering around a microprocessor in the control circuit 25 differ from conventional ones.

Figure 2:
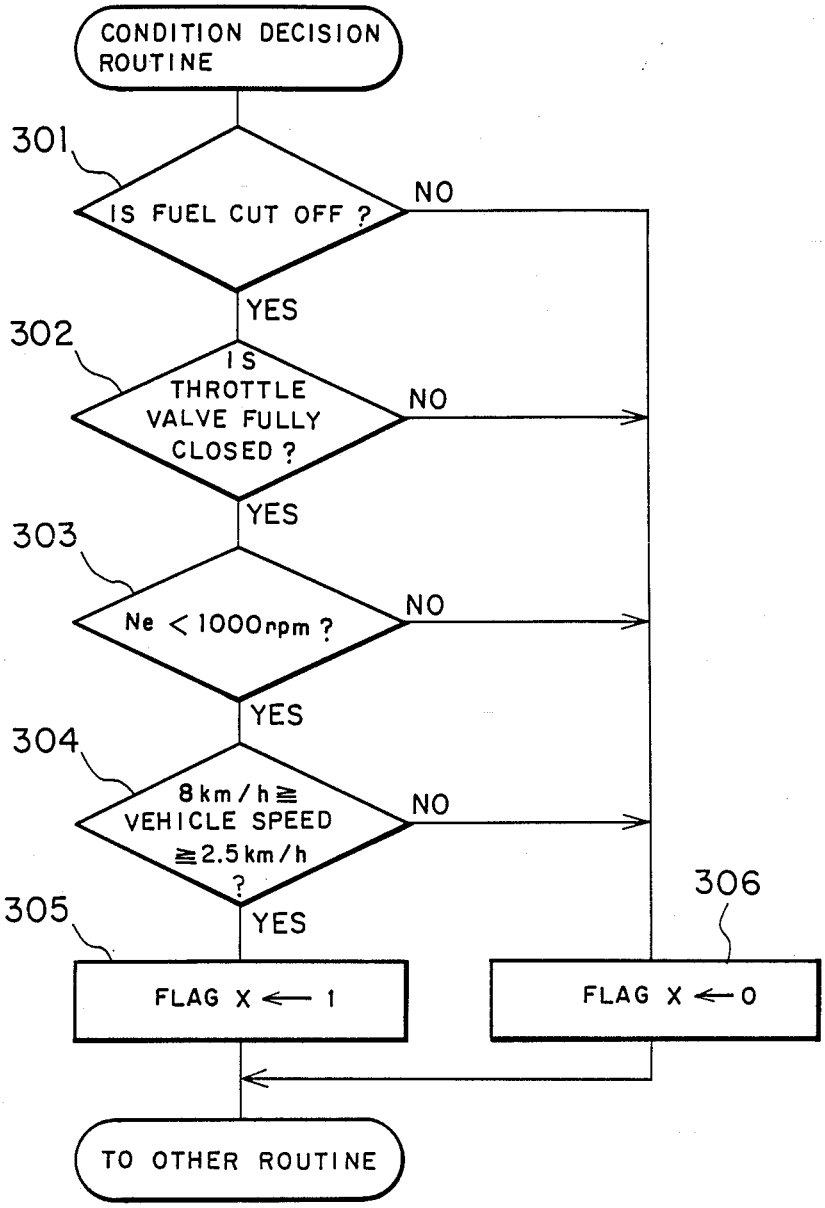
FIG. 2 PRIOR ART
FIGS. 2 and 3 are flowcharts showing the operation of the conventional device.
Figure 3:
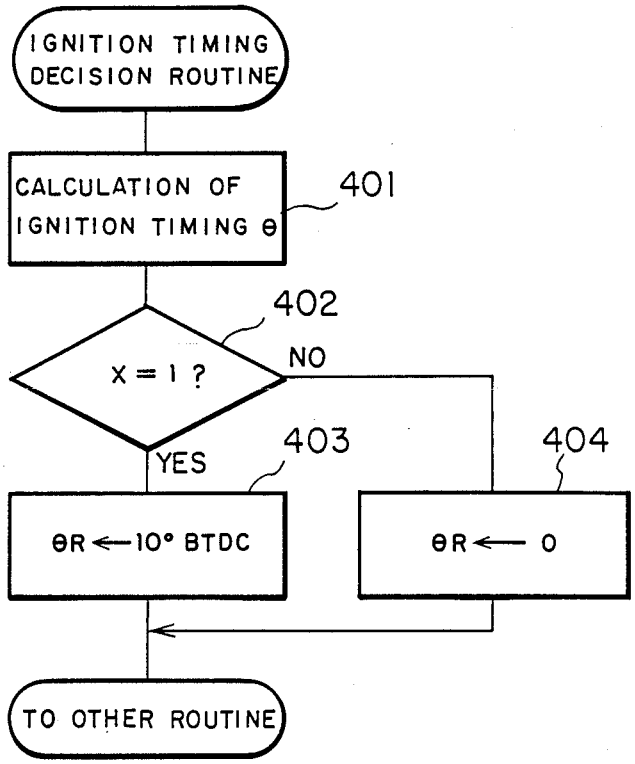
FIG. 3 PRIOR ART
Figure 4:
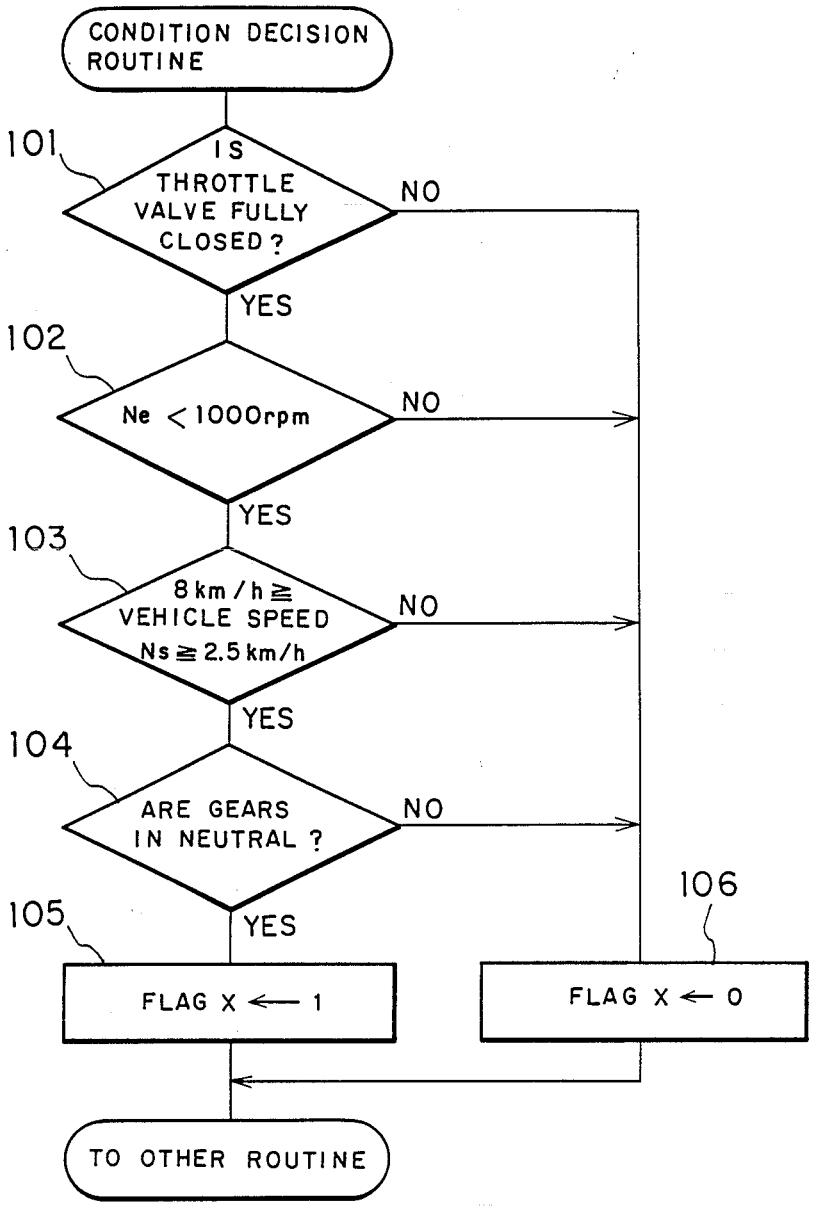
FIGS. 4 and 5 are flowcharts for explaining one embodiment of an electronic control device for internal-combustion engines of the present invention.

Next, its operation will be described by referring to the flowcharts of FIGS. 4 and 5. FIG. 4 shows a decision routine for deciding the slow-speed hunting state. Steps 101 to 103 are the same as steps 302 to 304 in FIG. 2. In a conventional device, a decision is made at Step 301 on whether or not the fuel is being cut off; in this invention, however, this decision is not executed. This is because the engine will stall if the fuel is cut off at less than 1000 rpm, and accordingly the fuel will never be cut off below 1000 rpm and only the condition at Step 102, the number of revolutions of engine of 1000 rpm, is satisfactory. In this invention, the number of revolutions of engine Ne-to-vehicle speed Ns ratio $r=Ne/Ns$ is determined at Step 104, and when this ratio r has exceeded a specific value $r_o$, the gears are judged to be not in neutral, thus proceeding to Step 105. At Step 105, like Step 305 for a conventional device, the flag will be $X=1$ when "Yes" is decided at Steps 101 to 104; and when "No" is decided at Steps 101 to 104, the flag will be set as $X=0$ at Step 106, thus ending the processing.

Figure 5:
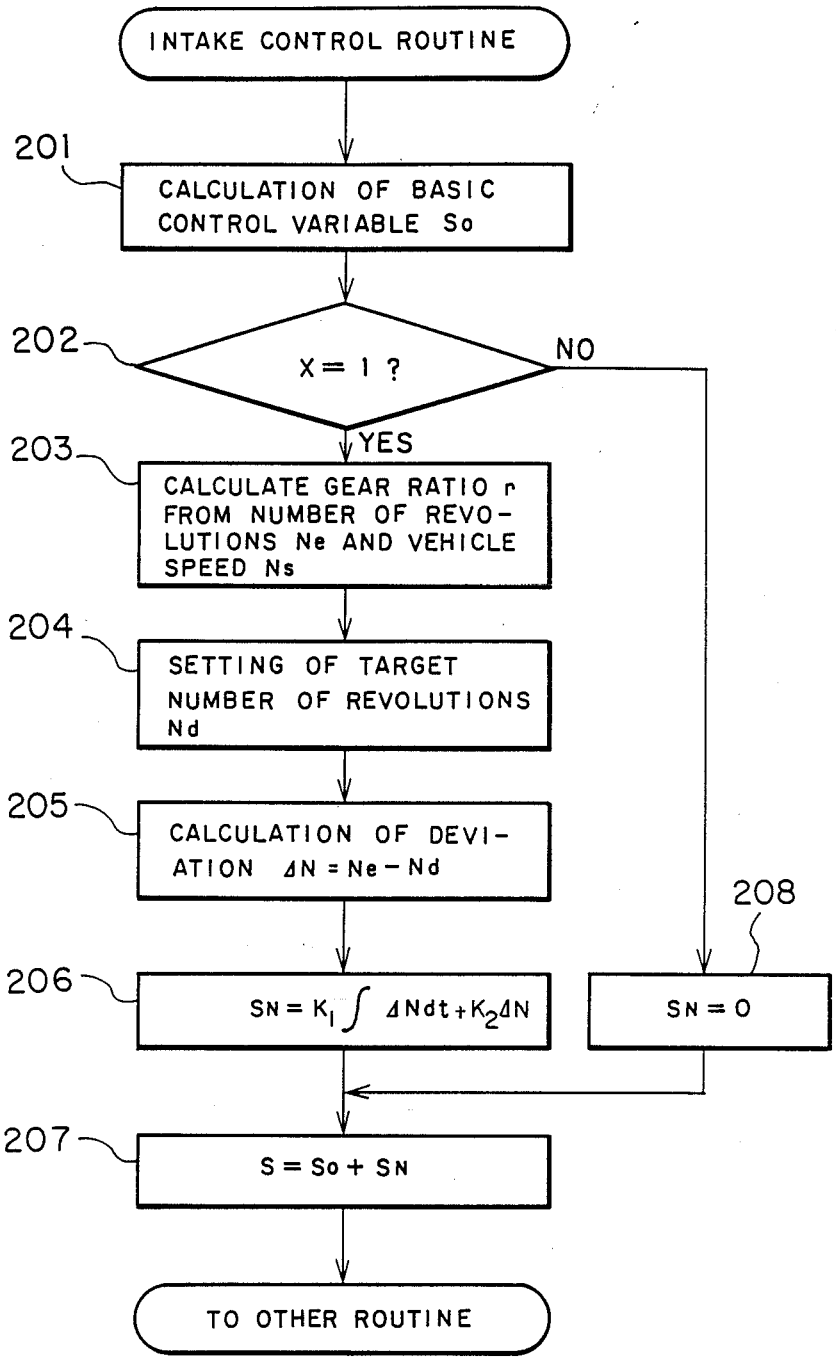

Subsequently, the intake control of FIG. 5 is processed on the basis of a result of processing of the slow-speed hunting state decision routine in FIG. 4. Step 201 is a step for calculating a basic controlled variable So for setting ISCV12 to a specific amount of opening; So is calculated in accordance with engine temperatures and a loaded condition of air conditioner. Next, at Step 202, when $X=1$, namely when it is decided that the vehicle is in a slow-speed hunting state, the processing proceeds to Step 203 to calculate the gear ratio r from the number of revolutions of engine Ne and the vehicle speed Ns. Subsequently, at Step 204, a target number of revolutions Nd is set on the basis of such conditions as the gear ratio and a loaded state of the air conditioner and others. At step 205, a deviation $\Delta N$ betwen the number of revolutions Ne and the target number of revolutions Nd is calculated. At Step 206, the amount of feedback SN proportional to the integral value of this deviation $\Delta N$ is calculated. $S_N$ can be calculated by integral calculus, multiplying by a proportional gain $K_2$, or a combination of both. At this time, the integral gain $K_2$ or proportional gain $K_2$ may be changed to a reasonable value on the basis of the gear ratio r given by calculation when needed at Step 203. Subsequently, at Step 207, a sum S of the basic controlled variable So and the amount of feedback SN is calculated. It is clear the controlling ISCV12 by this S decreases the rotational deviation $\Delta N$, the number of revolutions being controlled to the target value. Detailed description, therefore, will be omitted. On the other hand, when $X\neq1$, or when the engine is not in the slow-speed hunting state, at Step 202, the processing proceeds to Step 208, where since the amount of feedback is $SN=0$, the aforesaid control will not be effected.

As described above, the speed variation caused by slow-speed hunting can be prevented by the intake control, without accompanying a change in the number of revolutions.

In the embodiment described above, the target number of revolutions was set on the basis of such conditions as the gear ratio and the loaded state of air conditioner and other; however, a much more flexible control may be effected by calculating a mean value of the number of revolutions Ne by each specific time or a specific crank angle and by utilizing this mean value as the target number of revolutions Nd, instead of pre-considering various road surface and loaded conditions. In the intake control routine, no decision was made on whether or not the engine is an accelerating state, but a measure against slow-speed hunting and an acceleration correction may be adopted without running counter to each other, thus obtaining a good driving feeling, by judging that the engine has entered into an accelerating state after Step 207, from the number of revolutions, vehicle speed, throttle valve opening, quantity of air taken in, intake pressure, and a value given by dividing the quantity of air taken in by the number of revolutions, and by additionally executing the processing of the quantity of intake feedback $S_N=0$.

In the embodiment described above, a fuel injection device of a speed density system was adopted as an example of the fuel injection system, but the present invention is applicable also to a system of fuel injection device and electronically controlled carburetor using an air flow sensor.

Figure 6:
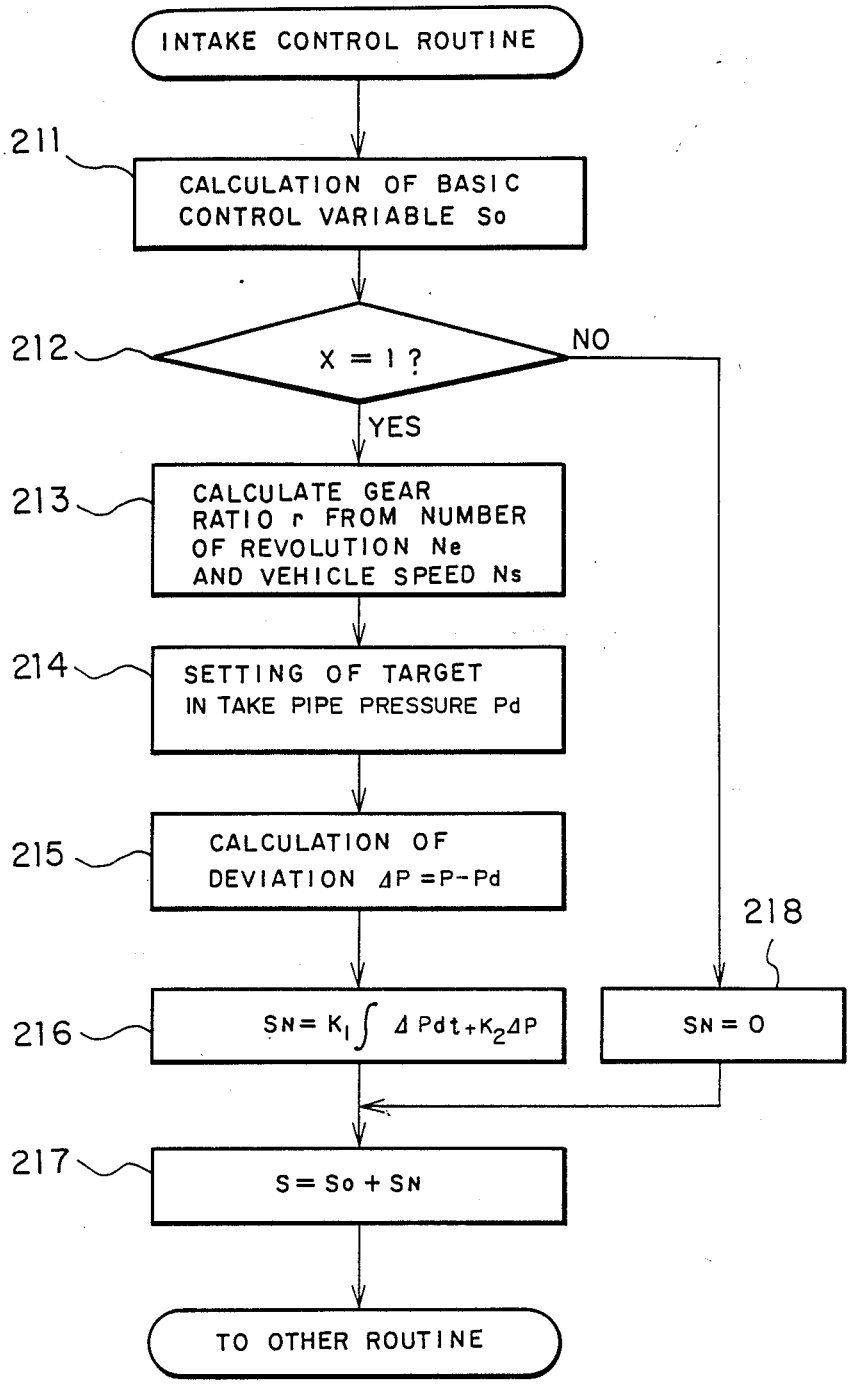
FIG. 6 is a flowchart showing the operation of an electronic control device of another embodiment of the present invention.

FIG. 6 is a flowchart for explaining the operation of another embodiment of this invention; the intake control processing of FIG. 6 is performed on the basis of a result of processing of the slow-speed hunting state decision routine in FIG. 4. Step 211 is a step for calculating the basic controlled variable So by which ISCV12 is set to a specific amount of opening. So is calculated in accordance with engine temperatures and a loaded condition of air conditioner, etc. Subsequently, when, at Step 212, $X=1$, that is, when the engine is judged to be in the slow-speed hunting state, the processing proceeds to Step 213, where the gear ratio r is calculated from the number of revolutions Ne and the vehicle speed Ns. Subsequently, at Step 214, a target intake pipe pressure Pd is set from such conditions as the gear ratio and the loaded conditions of air conditioner, etc. At Step 215, a devision ΔP between the intake pipe pressure P and the target intake pipe pressure Pd is calculated. At Step 216, the amount of feedback SN proportional to the integral value of this devision P is calculated. $S_N$ is calculated similarly to step 206 of FIG. 5. At this time the integral gain $K_1$ or proportional gain $K_2$ may be changed to a reasonable value, when needed, on the basis of the gear ratio r calculated at Step 213. Next, at Step 217, the sum S of the basic controlled variable So and the amount of feedback SN is calculated. Since it is manifest that controlling ISCV12 by this S decreases the intake pipe pressure deviation P, controlling the intake pipe pressure to a target value, its detailed description is omitted here. On the other hand, when, at Step 212, $X \neq 1$, that is, when the engine is not in the slow-speed hunting state, the processing proceeds to Step 218, where the amount of feedback will be SN=0, and accordingly the aforesaid control will not be executed.

The change of the intake pipe pressure caused by the slow-speed hunting can be prevented through the control of the quantity of air taken in as described above, and accordingly no change will occur in the number of revolutions.

In the embodiment given above, the target intake pipe pressure is set from such conditions as the gear ratio and the loaded condition of the air conditioner, etc., but a much more flexible control will become possible by calculating a mean value of the intake pipe pressure P by each specific time or by each specific crank angle, instead of pre-considering varied road surface conditions and loaded conditions. Furthermore, in the intake control routine, no decision was made on whether the engine is in the accelerating state, but a measure against slow-speed hunting and an acceleration correction may be adopted without running counter to each other, thus obtaining a good driving feeling, by judging that the engine has entered into an accelerating step after Step 217, from the number of revolutions, vehicle speed, throttle valve opening, quantity of air taken in, intake pressure, and a value given by dividing the quantity of air taken in by the number of revolutions, and by additionally executing the processing of the amount of intake feedback SN=0.

In the embodiment described above, a fuel injection device of a speed density system was adopted as an example of the fuel injection system, but the present invention is applicable also to a system of fuel injection device and electronically controlled carburetor using an air flow sensor. In this fuel injection device using an air flow sensor, the control parameter is the quantity of air taken in or a value given by dividing this quantity of air taken in by the number of revolutions, and because it is self-evident that a control is made such that this value will be a target value, detailed description is omitted here.

According to this invention, as described above, when the slow-speed hunting state of the engine is detected by the number of revolutions of the engine, vehicle speed, and loaded condition, the quantity of air taken in is controlled to be fed back in accordance with a deviation between the number of revolutions of the engine and the target number of revolutions, or with a deviation between at least one of the quantity of air taken into the engine, intake pipe pressure and a value given by dividing the quantity of air taken in by the number of revolutions, and its target value; therefore, it is possible to control quickly to a target value even if any rotational variations has taken place, and the number of revolutions can be controlled along with it, thereby preventing the slow-speed hunting and constantly insuring a good driving feeling.

What is claimed is:

1. An electronic control device for an internal combustion engine of a motor vehicle, comprising:

means for sensing the number of revolutions per minute (rpm) of said engine;

means for sensing a minimum loaded condition of said engine;

means for controlling the quantity of air intake into said engine;

control means for applying a correction signal to said means for controlling, said correction signal including at least one of an integral value and a proportional value of a difference between said number of rpm sensed by said sensing means and a target number of rpm, to adjust the quantity of air intake into said engine such that said difference will decrease, when said sensed rpm and said vehicle speed are within a predetermined range and said engine is in said minumum loaded condition;

said integral value and proportional value being multiplied by an integral gain and a proportional gain respectively to obtain said correction signal; and means for sensing a variable speed ratio of said engine or a ratio of said sensed rpm to said vehicle speed and changing at least one of said integral gain and said proportional gain in accordance with the sensed ratio.

2. An electronic control device for an internal-combustion engines as claimed in claim 1, wherein the application of said correction signal to said intake control means is stopped when the transient state of the engine has been detected from at least one value of the number of rpm of the engine, vehicle speed, throttle valve opening, quantity of air taken in, intake pressure, and a value given by dividing the quantity of air taken in by the number of rpm.

3. An electronic device for an internal-combustion engine as claimed in claim 1 or 2, wherein a mean value of the number of rpm of said engine is calculated by each specific time or by each specific engine crank angle, and this mean value is used as said target number of rpm.

* * * * *

UNITED STATES PATENT AND TRADEMARK OFFICE

CERTIFICATE OF CORRECTION

PATENT NO. : 4,877,002

DATED : October 31, 1989

INVENTOR(S) : SETSUHIRO SHIMOMURA ET AL.

It is certified that error appears in the above-identified patent and that said Letters Patent is hereby corrected as shown below:

Col. 1, line 26, "coontrols" should be --controls--;
Col. 1, line 42, "to" should be --from--; same line, "froma" should be --to a--;
Col. 1, line 50, after "conditioner" insert --;--.
Col. 4, line 5, "betwen" should be --between--;
Col. 4, line 8, "SN" should be --$S_N$--;
Col. 4, line 12, "$K_2$" (first occurrence) should be --$K_1$--;
Col. 4, line 16, "SN" should be --$S_N$--;
Col. 4, line 23, "SN" should be --$S_N$--;
Col. 4, line 39, "is" should be --was in--.
Col. 5, line 4, "devision" should be --deviation--;
Col. 5, line 7, "SN" should be --$S_N$--;
Col. 5, line 8, "sion" should be --ation--;
Col. 5, line 13, "SN" should be --$S_N$--;
Col. 5, line 21, "SN" should be --$S_N$--;
Col. 5, line 42, "step" should be --state--;
Col. 5, line 47, "SN" should be --$S_N$--.
Col. 6, line 45, "engines" should be --engine--.

Signed and Sealed this

Twenty-seventh Day of November, 1990

*Attest:*

HARRY F. MANBECK, JR.

*Attesting Officer*

*Commissioner of Patents and Trademarks*